United States Patent [19]

Taylor

[11] Patent Number: 4,716,664

[45] Date of Patent: Jan. 5, 1988

[54] BOWLING SHOES AND IMPROVED HEEL CONSTRUCTION THEREFOR

[76] Inventor: Wilson G. Taylor, P.O. Box 146, San Gabriel, Calif. 91776

[21] Appl. No.: 371,273

[22] Filed: Apr. 23, 1982

[51] Int. Cl.[4] ..... A43B 5/00; A43B 21/18

[52] U.S. Cl. ..... 36/114; 36/130; 36/34 R

[58] Field of Search ..... 36/130, 34 R, 35 A, 36/105, 103, 114, 115

[56] References Cited

U.S. PATENT DOCUMENTS

| | | | |
|---|---|---|---|
| D. 31,497 | 9/1899 | Rystrom | 36/34 R |
| D. 97,311 | 10/1935 | Troy | 36/34 R |
| 745,393 | 12/1903 | Small | 36/35 A |
| 1,580,475 | 4/1926 | Farnan | 36/130 X |
| 3,011,272 | 12/1961 | Goldenberg | 36/130 |
| 3,031,777 | 5/1962 | Leffler | 36/130 |
| 3,195,244 | 7/1965 | Whitcas | 36/130 |

*Primary Examiner*—Stephen Marcus
*Assistant Examiner*—T. Graveline
*Attorney, Agent, or Firm*—Pretty, Schroeder, Brueggemann & Clark

[57] ABSTRACT

A bowling shoe to be worn on the sliding foot of a bowler has a heel that presents outer and inner bottom surfaces, the outer bottom surface having a relatively high coefficient of friction as compared to the inner surface. The outer surface can be white rubber and the inner surface can be leather. Preferably the heel is U-shaped for improved stability. A shoe for the non-sliding foot has a sole with a higher coefficient of friction and a uniform heel surface.

11 Claims, 5 Drawing Figures

BOWLING SHOES AND IMPROVED HEEL CONSTRUCTION THEREFOR

FIELD OF THE INVENTION

The present invention relates to the sport of bowling, and more particularly to shoes for use by bowlers.

BACKGROUND OF THE INVENTION

A bowler's success is, to a very great extent, dependent upon maintaining the optimum body position at the critical point at which the foul line is approached and the arm swings forward with the ball. The upper body should be precisely perpendicular to the bowler's target line (a straight line extending away from the bowler along which the ball begins its movement down the lane) so that the throwing arm can swing freely at a ninety degree angle to the shoulder axis. Bowlers who do not achieve this "square" body position may be able to execute effective shots on occasion, but the consistency required to become a bowler of the first rank will allude them.

Maintenance of a proper upper body position is made difficult by the required foot movement toward the end of the bowler's approach. The last step is taken with the foot on the opposite side from the ball. Thus a right-handed bowler steps last with the left foot which moves forward with a sliding motion as the ball is released. Accordingly, in the case of a right-handed bowler, the left foot is referred to as the "sliding foot" and the right foot as the "non-sliding foot." High quality bowling shoes provide a left shoe with a sole or a part of a sole at the toe that slides more easily than the right shoe. The sole of the left shoe may be smooth leather, while the sole of the right shoe is rougher leather or rubber (this being reversed for a left-handed bowler). Any rubber used is white rubber to avoid marking the lane.

The sliding foot should ideally be placed under the center of gravity of the bowler's body and should slide toward the pins while aligned with the direction in which the ball is thrown. This can be a difficult motion and many bowlers incorrectly place the sliding foot on the lane at such an angle that it is pointed toward the side on which the ball is carried. As a result, the upper body tends to depart from the desired square position and the entire delivery is adversely affected. The follow-through angle becomes less than ninety degrees, as explained in more detail below, with a loss of effectiveness when the ball contacts the pins.

SUMMARY OF THE INVENTION

The present invention provides bowling shoes that greatly assist the bowler in achieving proper orientation of the sliding foot and maintaining the desired follow-through angle. One aspect of the invention resides in a heel for a bowling shoe and in a shoe provided with such a heel for the sliding foot. The heel presents two different bottom surfaces, an outer surface and an inner surface. The outer surface has a higher coefficient of friction and may be made of white rubber while the inner surface has a lower coefficient of friction and may be made of leather. Thus, the heel tends to turn the toe of the foot outwardly, keeping the foot under the bowler's center of gravity and properly aligned with respect to the bowler's forward motion. Preferably the heel is U-shaped and should be mounted on the shoe so that it defines a centered recess that opens forwardly toward the sole.

It is most advantageous to provide a bowling shoe with a heel as described above along with a companion shoe for the non-sliding foot that is of a different construction. Its heel has a uniform bottom surface and its sole has a higher coefficient of friction than the sole of the sliding foot shoe.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 4:
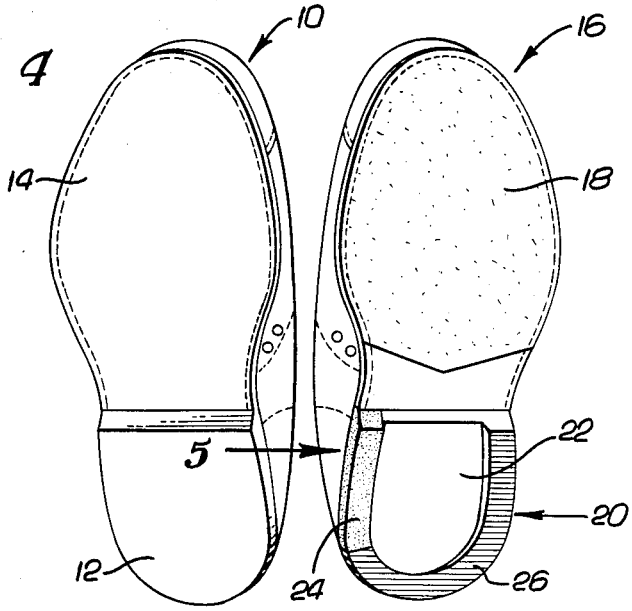
FIG. 4 is a bottom plan view of a pair of bowling shoes constructed in accordance with the present invention.

An exemplary pair of bowling shoes, shown in FIG. 4 and constructed in accordance with the present invention, are intended for use by a right-handed bowler. The right shoe 10, which is worn on the non-sliding foot, is of conventional construction. It has a heel 12 that presents a uniform bottom surface, preferably of white rubber, to contact the lane. The sole 14 is of white rubber or roughened leather depending on individual preferences. It has non-slip characteristics that are suitable for ordinary walking.

The left shoe 16, which is for the sliding foot, is of an unusual construction and does not match the right shoe 10. It has a sole 18, preferably of smooth leather, that has a substantially lower coefficient of friction than the sole 14 of the right shoe 10. The heel 20 is U-shaped, defining a central recess 22 that opens forwardly toward the sole 18. Accordingly, the heel 20 has a U-shaped bottom surface that contacts the lane. If preferred, the recess 22 may extend upwardly only part way through the heel 20, so that only the lower portion of the heel that contacts the lane is U-shaped.

Figure 1:
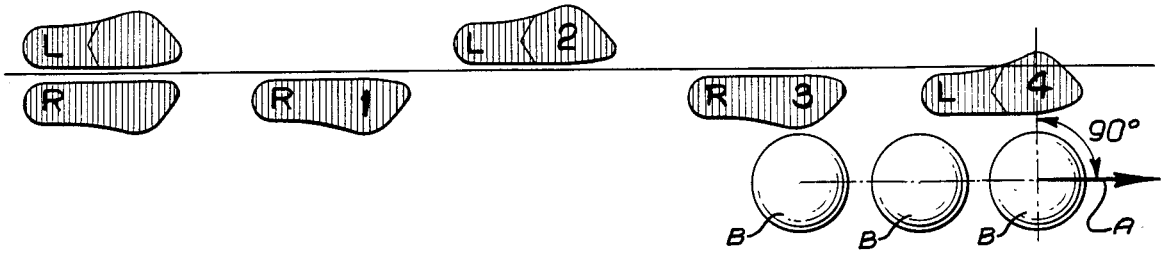
FIG. 1 is a diagrammatic illustration of successive placements of a bowler's feet during the approach and proper execution of a throw.
Figure 5:
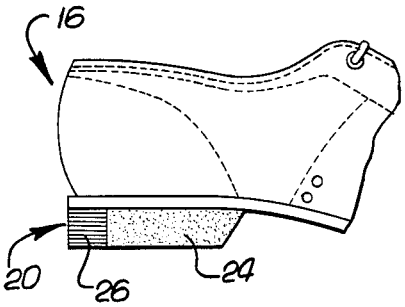
FIG. 5 is a fragmentary side elevation of the heel portion of the left (sliding foot) shoe of the pair of FIG. 4.

The exemplary heel 20 shown in FIGS. 1 and 5 is made in two sections 24 and 26. A first section 24 corresponds to the inside portion of the bottom surface of the heel 20, while a second section 26 corresponds to the outside and rear surfaces of the heel. The first section 24 is made of a material such as smooth leather having a relatively low coefficient of friction and the second section 26 is made of a material such as white rubber having a relatively high coefficient of friction.

Stability of the heel 20 and the uniform distribution of pressure on its bottom surface is an important consideration and it is for this reason that a U-shaped configuration is used. Any unevenness of the supporting lane surface within the recess 22 will have no effect on the pressure distribution on the heel 20.

Figure 2:
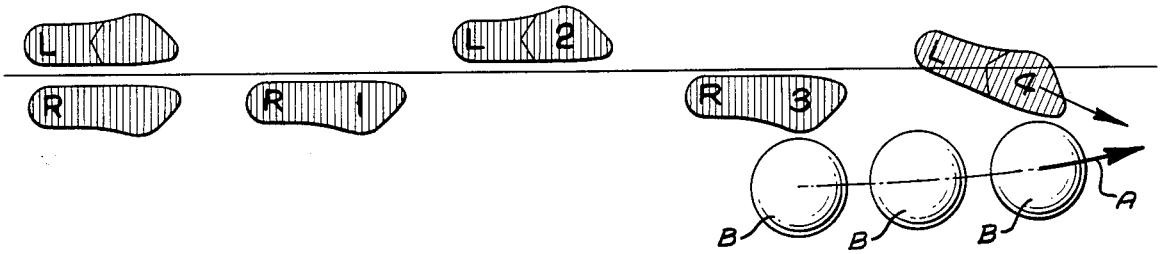
FIG. 2 is a similar diagrammatic illustration showing an incorrect placement of the sliding foot.
Figure 3:
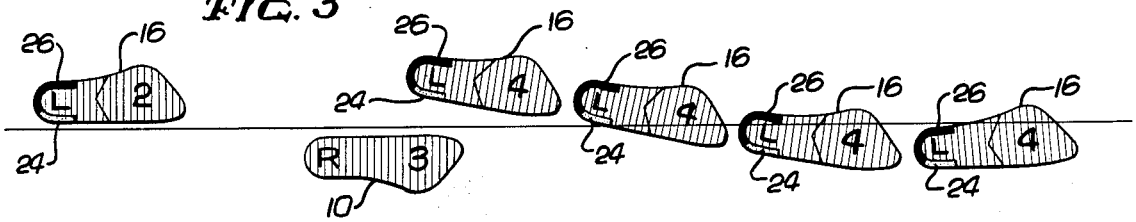
FIG. 3 is another such diagrammatic illustration showing improper placement of the sliding foot followed by a correction as brought about by the present invention.

The effect of the shoes 10 and 16 on a bowler's performance will now be considered with respect to FIGS. 1–3. An optimum placement of a right-handed bowler's left (L) and right (R) feet during an approach and delivery is illustrated in FIG. 1. Three normal steps are taken as indicated by the foot prints 1, 2 and 3, the third of these steps being taken with the right foot. The left foot then crosses over and is then placed directly in front of the right foot, oriented in perfect alignment with the bowler's forward motion (print 4). The left foot becomes the sliding foot and the right foot becomes the non-sliding foot. As the bowler slides forward on the left foot, the ball B is thrown. The bowler's shoulder axis (a line passing across the bowler's body through the shoulders) remains square, i.e., perpendicular to the forward motion and the target line, and the follow-through angle is ninety degrees. This is the angle between the forward swing of the bowler's throwing arm (indicated by the arrow A) and the shoulder axis.

Many bowlers, however, have difficulty achieving the combination of back position, foot speed, thigh muscle action, arm swing, and other factors to throw the ball as illustrated in FIG. 1. Typically their approach is more similar to that illustrated in FIG. 2. The important difference occurs on the fourth and final step when the left foot is not positioned directly ahead of and in alignment with the right foot. Instead, the left toe points to the right and the sliding foot does not remain under the bowler's center of gravity. To compensate for this improper foot position, the bowler deviates from the proper ninety degree follow-through angle. The throwing arm moves across the body to the left forming a follow-through angle of 85, 80, 70 or even as little as 50 degrees in some cases. As a result the ball does not gain enough traction on the lane to perform as desired. Even if it contacts the pins at the proper location, it will be deflected excessively on impact.

The present invention has a pronounced corrective action on a bowler who experiences the difficulty illustrated in FIG. 2. The second, third and fourth steps of such a correction are illustrated in FIG. 4 which shows a series of successive positions of the sliding left foot. Although the left foot begins to contact the lane at an improper angle, that angle is corrected by the shoe as the foot slides forward.

The sole 18 of the left shoe 16 slides freely, as in the case of a traditional bowling shoe intended for the sliding foot. The heel 20, however, is frictionally unbalanced and acts like a rudder. The outside rubber section 26 of the heel 20 tends to grip the lane with a braking action, while the leather inner section 24 slides more freely. As a result, the inside of the sliding shoe 16 moves faster than the outside and the shoe turns toward a proper orientation. The bowler can then execute the throw with an optimum ninety degree follow-through angle. It should be noted that the action of the heel 20 is less affected by any surface imperfections of the lane because of its U-shaped configuration.

Although the invention is explained above with respect to a right-handed bowler, it will be appreciated that the construction of the two shoes 10 and 16 can be readily reversed in the case of a left-handed bowler. While a particular form of the invention has been illustrated and described, it will be apparent that various modifications can be made without departing from the spirit and scope of the invention.

I claim:

1. A pair of bowling shoes comprising:

a first shoe to be worn on a bowler's non-sliding foot having a relatively high friction sole; and a second shoe to be worn on said bowler's sliding foot having a relatively low friction sole as compared to said first shoe, said second shoe having a heel that presents an outer bottom surface on the side thereof farthest from said non-sliding foot when so worn and an inner bottom surface on the side thereof nearest form said non-sliding foot when so worn, said outer bottom surface having a relatively high coefficient of friction as compared to said inner bottom surface, whereby said heel tends to center said second shoe with respect to the center of gravity of said bowler and align said second shoe with respect to the forward motion of said bowler, leading to a more square body position as a ball is thrown.

2. The shoes of claim 1 wherein said outer bottom surface is rubber.

3. The shoes of claim 1 wherein said inner bottom surface is leather.

4. The shoes of claim 1 wherein:

said outer bottom surface is white rubber; and said inner bottom surface is leather.

5. The shoes of claim 1 wherein said heel of said second shoe defines a recess at the center thereof.

6. The shoes of claim 1 wherein at least part of said heel of said second shoe is U-shaped, defining a recess at the center thereof opening toward said sole of said second shoe.

7. The shoes of claim 6 wherein said outer bottom surface is white rubber.

8. The shoes of claim 6 wherein said inner bottom surface is leather.

9. The shoes of claim 6 wherein:

said outer bottom surface is white rubber; and said inner bottom surface is leather.

10. The shoes of claim 1 wherein said first shoe has a heel with a substantially uniform bottom surface.

11. A pair of bowling shoes comprising:

a first shoe to be worn on a bowler's non-sliding foot having a relatively high friction sole, said first shoe having a heel with a substantially uniform bottom surface; and a second shoe to be worn on said bowler's sliding foot having a lower friction sole as compared to said first shoe, said second shoe having a heel that is at least partially U-shaped and defines a recess opening toward the sole thereof, said heel presenting an outer bottom surface of white rubber on the side thereof farthest from said non-sliding foot when so worn and an inner bottom surface of leather on the side thereof nearest said non-sliding foot when so worn, whereby said heel tends to center said second shoe with respect to the center of gravity of said bowler and align said second shoe with respect to the forward motion of said bowler, leading to a more square body position as a ball is thrown.

* * * * *